US010161705B2

(12) United States Patent
Keng et al.

(10) Patent No.: US 10,161,705 B2
(45) Date of Patent: Dec. 25, 2018

(54) MAGAZINE FLOORPLATE WITH ONE OR MORE RETAINING CLIPS FOR A FIREARM

(71) Applicants: Shane Keng, Marietta, GA (US); Eric Chang, Marietta, GA (US)

(72) Inventors: Shane Keng, Marietta, GA (US); Eric Chang, Marietta, GA (US)

(73) Assignee: Shane Keng, Marietta, GA (US)

( * ) Notice: Subject to any disclaimer, the term of this patent is extended or adjusted under 35 U.S.C. 154(b) by 0 days.

(21) Appl. No.: 15/367,661

(22) Filed: Dec. 2, 2016

(65) Prior Publication Data

US 2017/0160038 A1 Jun. 8, 2017

Related U.S. Application Data

(60) Provisional application No. 62/263,324, filed on Dec. 4, 2015.

(51) Int. Cl.
*F41A 23/04* (2006.01)
*F41A 9/65* (2006.01)

(52) U.S. Cl.
CPC ..... *F41A 23/04* (2013.01); *F41A 9/65* (2013.01)

(58) Field of Classification Search
CPC .. F41A 23/04; F41A 9/65; F41A 23/08; F41A 23/10; F41A 23/16; F41A 23/18; F41A 23/02; F41C 23/14; F41C 27/00; F41C 23/12; F41C 27/22
USPC ..... 42/94, 90, 50
See application file for complete search history.

(56) References Cited

U.S. PATENT DOCUMENTS 4,026,055 A * 5/1977 Weast ..... F41G 11/003 42/124
4,127,954 A * 12/1978 Hausmann ..... F41A 9/68 42/50
4,393,614 A 7/1983 Pickett
4,414,769 A * 11/1983 Mueschke ..... F41A 35/06 42/70.01
4,520,585 A * 6/1985 Barrett ..... F41C 23/10 42/7
4,790,094 A * 12/1988 Chesnut ..... F41A 9/69 42/50
4,862,620 A * 9/1989 Chesnut ..... F41A 9/69 42/50
D344,780 S * 3/1994 Jenkins ..... D22/108
5,377,437 A 1/1995 Underwood
5,642,582 A * 7/1997 Grams ..... F41A 9/65 42/50
5,666,752 A * 9/1997 Grams ..... F41A 9/71 42/49.02
5,768,819 A * 6/1998 Neal ..... F41A 17/00 42/70.07
6,269,577 B1 * 8/2001 Hardy ..... F41A 35/00 42/127
6,370,806 B1 * 4/2002 Klebes ..... F41A 9/65 42/7

(Continued)

*Primary Examiner* — Joshua E Freeman
(74) *Attorney, Agent, or Firm* — Eversheds Sutherland (US) LLP

(57) ABSTRACT

A shooting rest is disclosed herein. The shooting rest may include a magazine floor coupling configured to couple to a bottom portion of a firearm magazine. The shooting rest also may include one or more removable retaining clips configured to maintain the magazine floor coupling to the bottom portion of the firearm magazine.

12 Claims, 6 Drawing Sheets

(56) References Cited

U.S. PATENT DOCUMENTS 6,481,136 B1 * 11/2002 Fitzpartick ..... F41A 9/65 42/18
6,557,287 B2 * 5/2003 Wollmann ..... F41A 9/65 42/50
6,668,479 B1 * 12/2003 Obong ..... F41A 9/63 206/3
6,698,127 B2 * 3/2004 Weber ..... F41A 9/65 42/49.01
7,117,622 B2 * 10/2006 Freed ..... F41A 9/65 42/7
7,124,528 B2 10/2006 Long
7,197,844 B2 4/2007 Benson
7,281,397 B2 * 10/2007 Victor ..... E05B 73/00 42/70.01
7,478,496 B2 1/2009 Bender
D593,634 S * 6/2009 Fitzpatrick ..... D22/108
7,669,357 B2 3/2010 Moody et al.
7,743,542 B1 * 6/2010 Novak ..... F41C 23/10 42/49.02
D642,647 S * 8/2011 Fitzpatrick ..... D22/108
8,127,480 B1 * 3/2012 McManus ..... F41A 9/82 42/49.02
8,418,390 B1 * 4/2013 Wright ..... F41A 9/61 42/49.01
8,590,202 B2 * 11/2013 Keng ..... F41A 9/65 42/90
8,590,203 B1 * 11/2013 McCarthy ..... F41A 17/44 42/50
D706,895 S * 6/2014 Zayatz ..... D22/108
8,898,949 B1 * 12/2014 Greenwood ..... F41G 1/387 42/124
D725,218 S * 3/2015 Iosilevsky ..... D22/108
9,097,480 B2 8/2015 Keng
2002/0029506 A1 * 3/2002 Wollmann ..... F41A 9/65 42/50
2005/0011097 A1 * 1/2005 Freed ..... F41A 9/65 42/49.02
2005/0011104 A1 * 1/2005 Oz ..... F41G 1/34 42/124
2008/0190003 A1 * 8/2008 Bolen ..... F41A 9/61 42/50
2009/0235569 A1 * 9/2009 Morando ..... F41A 9/65 42/108
2010/0043270 A1 * 2/2010 Mantas ..... F41A 9/65 42/49.01
2010/0154275 A1 * 6/2010 Faifer ..... F41A 9/61 42/90
2011/0173858 A1 * 7/2011 Troy ..... F41A 9/65 42/50
2012/0073429 A1 * 3/2012 Bowles ..... F41A 9/68 89/138
2012/0085013 A1 * 4/2012 Cahill ..... F41A 35/02 42/96
2012/0137564 A1 * 6/2012 Swenson, III ..... F41A 9/63 42/87
2012/0174452 A1 * 7/2012 Anderson ..... F41A 9/65 42/49.01
2012/0180360 A1 * 7/2012 Jones ..... F41A 11/02 42/75.03
2012/0198746 A1 * 8/2012 Keng ..... F41A 9/65 42/94
2012/0255979 A1 * 10/2012 Sitz ..... F41A 23/18 224/243
2013/0086834 A1 * 4/2013 Battaglia ..... F41A 9/65 42/49.02
2013/0145672 A1 * 6/2013 Tuller, Jr. ..... F41G 1/00 42/114
2013/0227870 A1 * 9/2013 Rendulic ..... F41A 9/65 42/50
2014/0033592 A1 * 2/2014 Fiorucci ..... F41A 9/83 42/87
2014/0047751 A1 * 2/2014 Lee ..... F41A 9/65 42/49.01
2014/0047755 A1 * 2/2014 McClintock ..... F41C 27/00 42/90
2014/0068992 A1 * 3/2014 Keng ..... F41A 9/65 42/94
2014/0196349 A1 * 7/2014 Rogers ..... F41G 11/003 42/90
2014/0305019 A1 * 10/2014 King, Jr. ..... F41C 23/18 42/71.01
2015/0121736 A1 * 5/2015 Faifer ..... F41A 9/65 42/49.01
2016/0069637 A1 * 3/2016 Kafer ..... F41C 23/16 42/49.1
2016/0265872 A1 * 9/2016 Tarazi ..... F41C 27/22
2016/0363407 A1 * 12/2016 Hanington ..... F41A 23/04
2017/0160038 A1 * 6/2017 Keng ..... F41A 23/04
2017/0254613 A1 * 9/2017 Kedairy ..... F41C 23/12

* cited by examiner

FIG. 5A
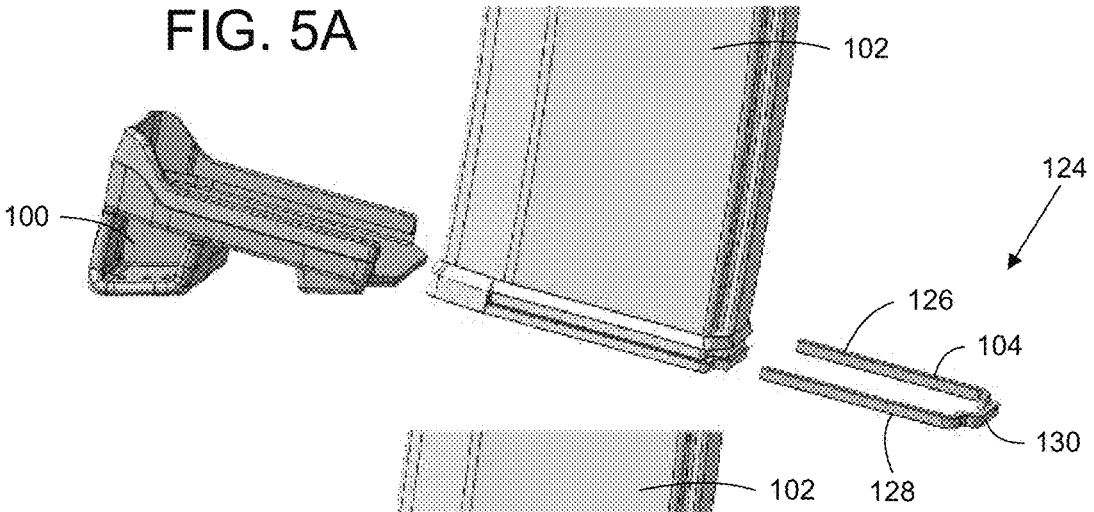
FIG. 5B
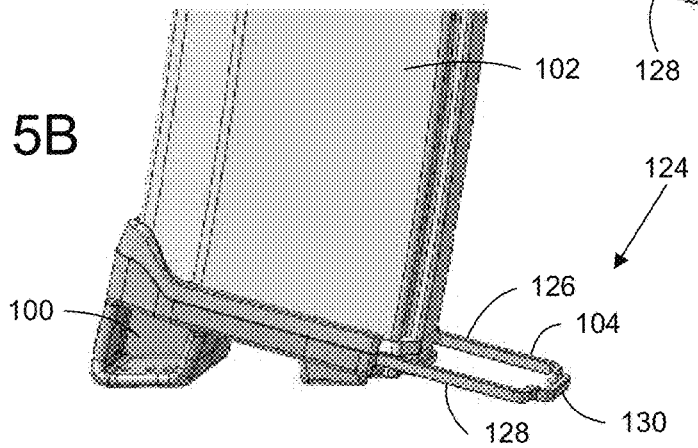
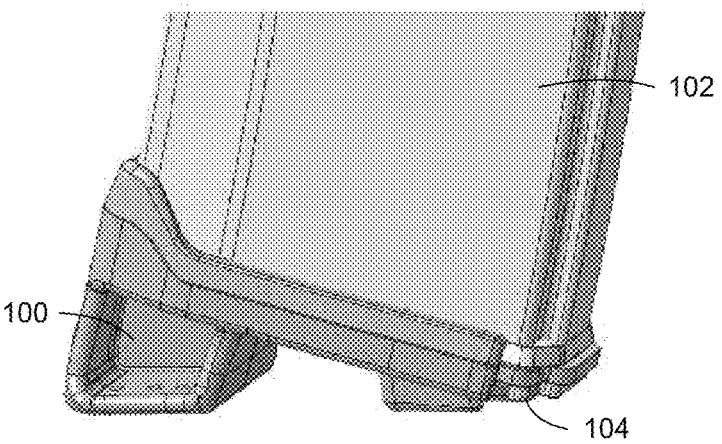
FIG. 5C

MAGAZINE FLOORPLATE WITH ONE OR MORE RETAINING CLIPS FOR A FIREARM

CROSS-REFERENCE TO RELATED APPLICATIONS

The disclosure claims priority to and the benefit of U.S. provisional application No. 62/263,324, filed Dec. 4, 2015, which is herein incorporated by reference in its entirety.

FIELD OF THE DISCLOSURE

The disclosure relates to shooting rest attachments for firearms and more particularly to magazine floorplate attachments with one or more retaining clips.

BACKGROUND

It is an advantage to use a stabilizing support when shooting, particularly if the target is far away. Movement while aiming can cause significant shifts in the point of impact downrange, so it is desirable to stabilize the firearm as much as possible when shooting. Conventional shooting rests for firearms in the form of bipods or monopods are known in the prior art. For example, U.S. Pat. No. 7,669,357 to Moody et al, U.S. Pat. No. 7,478,496 to Bender, U.S. Pat. No. 7,197,844 to Benson, U.S. Pat. No. 7,124,528 to Long, U.S. Pat. No. 5,377,437 to Underwood and U.S. Pat. No. 4,393,614 to Pickett are all illustrative of the prior art.

While these devices accomplish the task of stabilizing a firearm for improved accuracy, they add a significant amount of additional weight and bulk in order to provide the desired function. Likewise, said devices require some form of manipulation by the user prior to being used. Furthermore, due to the complexity of parts or materials used, the cost of manufacturing can be quite high. Accordingly, there exists a need in the art for a low cost and reliable shooting rest.

SUMMARY

Some or all of the above needs and/or problems may be addressed by certain embodiments of the shooting rest disclosed herein. The shooting rest may include a magazine floor coupling configured to couple to a bottom portion of a firearm magazine. The shooting rest also may include one or more removable retaining clips configured to maintain the magazine floor coupling to the bottom portion of the firearm magazine.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

FIGS. 5A-5C depict a sequence for attaching the shooting rest according to an embodiment.

DETAILED DESCRIPTION

According to an embodiment, an aspect of the disclosure is to provide a stable shooting rest device at the base of a magazine fed firearm. The shooting rest improves upon the prior art by being significantly smaller, lighter, and cheaper to manufacture. Also, the shooting rest is always in the deployed position and requires no additional manipulation prior to use.

Figure 1:
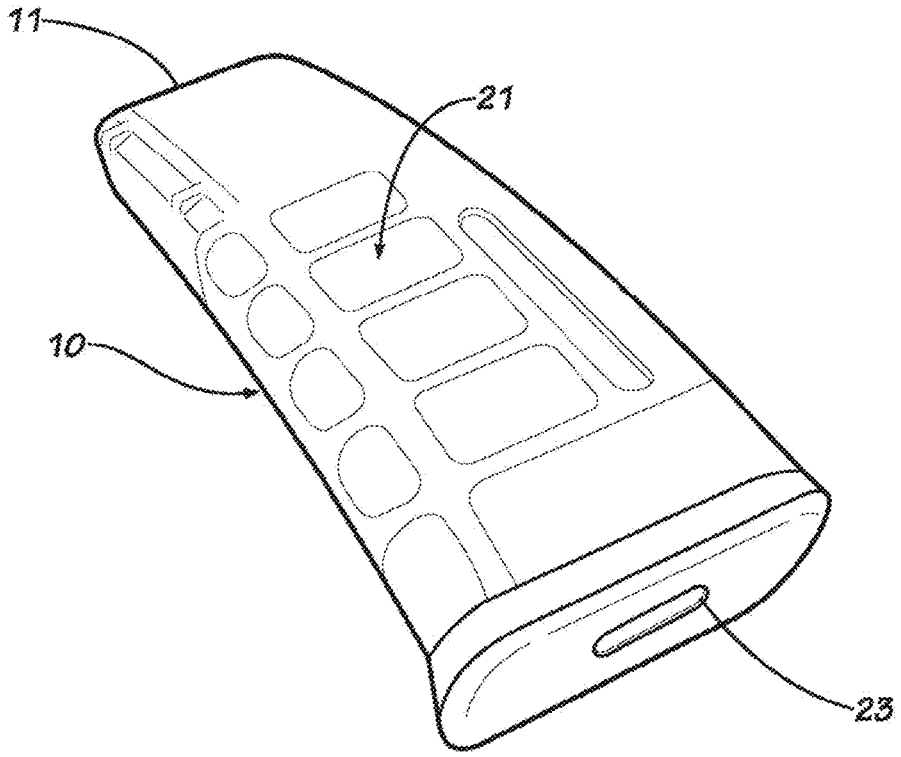
FIG. 1 depicts a perspective view of a box magazine for the M-16 rifle.
Figure 2:
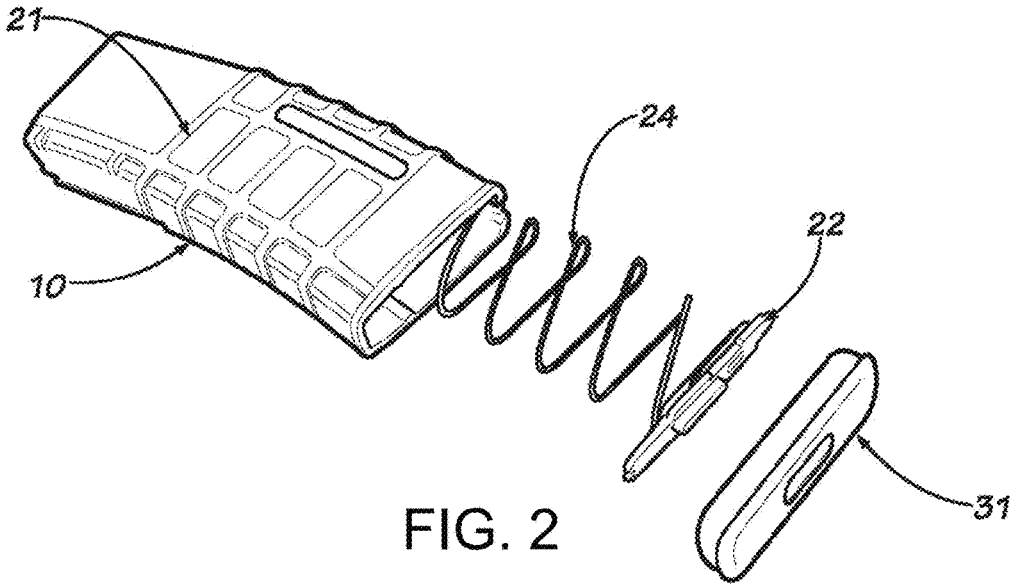
FIG. 2 depicts an exploded view of the magazine in FIG. 1.

FIG. 1 depicts a box fed magazine 10. The box fed magazine 10 is a device that has been widely used to feed ammunition into firearms. The basic structure of the M16/AR box magazine 10 is depicted in FIG. 1. The outer case of the magazine 21 is shaped to hold ammunition in a vertically stacked arrangement. The magazine includes a feed side 11, which dispenses ammunition into the feed mechanism of the firearm, and an end or floor side, which is covered by the floorplate 23. FIG. 2 is an exploded view of the box magazine referenced in FIG. 1 and depicts a magazine spring 24 and a magazine spring guide 22 that seats into a cutout 31 on the floorplate 23. Example box magazines may include the MagPul PMAG and/or the USGI 30-rd. One of ordinary skill in the art, however, will appreciate that the shooting rest discussed herein may be attached to the bottom portion of any box magazine known in the art by any means.

FIGS. 3A-8C depict example embodiments of various shooting rests disclosed herein. The shooting rest may be configured to couple to a bottom portion of a firearm magazine. In some instances, the shooting rest may include a magazine floor coupling configured to couple to a bottom portion of the firearm magazine. The shooting rests also may include a lower extension extending downward from the magazine floor coupling. In this manner, the shooting rests may be similar to the shooting rests disclosed in U.S. Pat. No. 9,097,480, which is herein incorporated by reference in its entirety. The shooting rests may be any size, shape, or configuration.

Figure 3A:
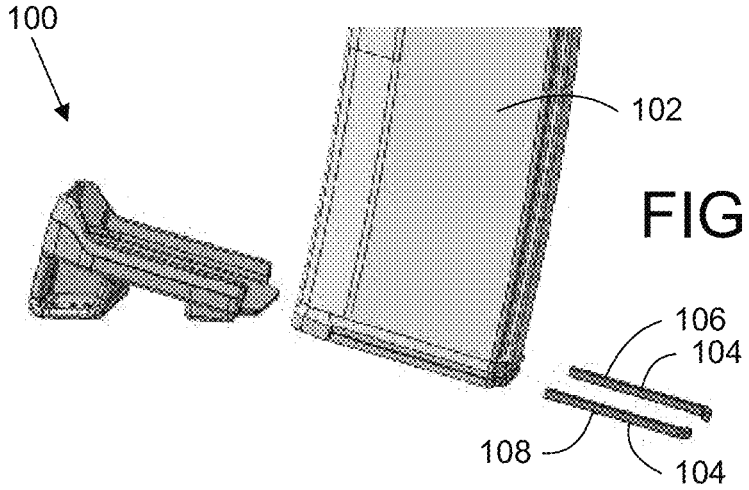
FIGS. 3A-3C depict a sequence for attaching the shooting rest according to an embodiment.
Figure 3B:
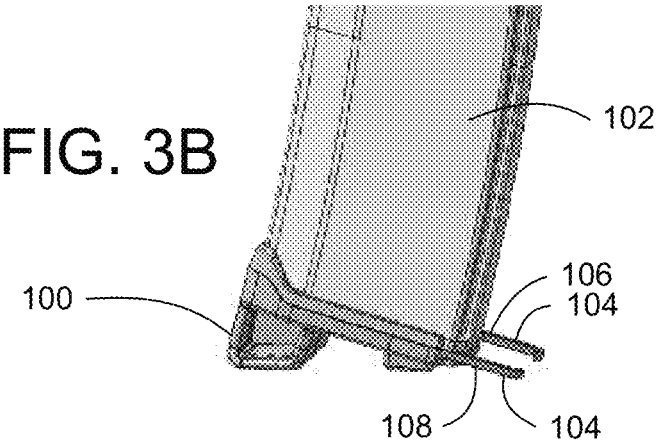
Figure 3C:
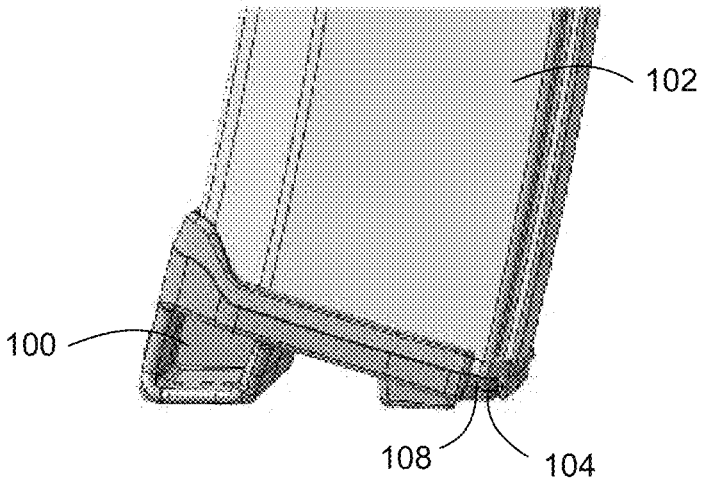

As depicted in FIGS. 3A-3C, a shooting rest 100 may be attached to a firearm magazine 102. The shooting rest 100 may include one or more removable retaining clips 104. The removable retaining clips 104 may be configured to maintain the magazine floor coupling to the bottom portion of the firearm magazine 102. The size and shape of the removable retaining clips 104 may vary. In some instances, as depicted in FIGS. 3A-3C, the one or more removable retaining clips 104 may comprise a first retaining clip 106 and a second retaining clip 108. The first retaining clip 106 may be at least partially disposed within a first side slot formed between the magazine floor coupling and the bottom portion of the firearm magazine 100, and the second retaining clip 108 may be at least partially disposed within a second side slot formed between the magazine floor coupling and the bottom portion of the firearm magazine 100. The first retaining clip 106 and the second retaining clip 108 may include an elongated portion, with a substantially transverse tab extending from one end thereof. The elongated portion may be partially or fully disposed within the respective side slots, and the tab may wrap around a back portion of the bottom portion of the firearm magazine 100. In some instances, the one or more retaining clips 104 may snap fit within the slots.

Figure 4A:
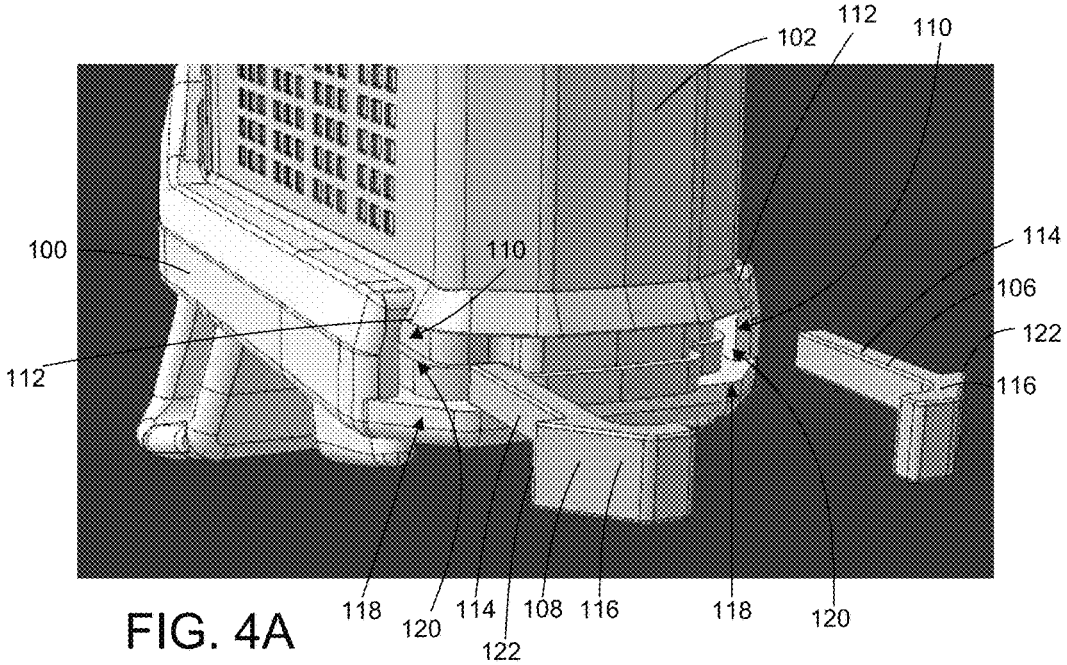
FIGS. 4A and 4B depict a sequence for attaching the shooting rest according to an embodiment.
Figure 4B:
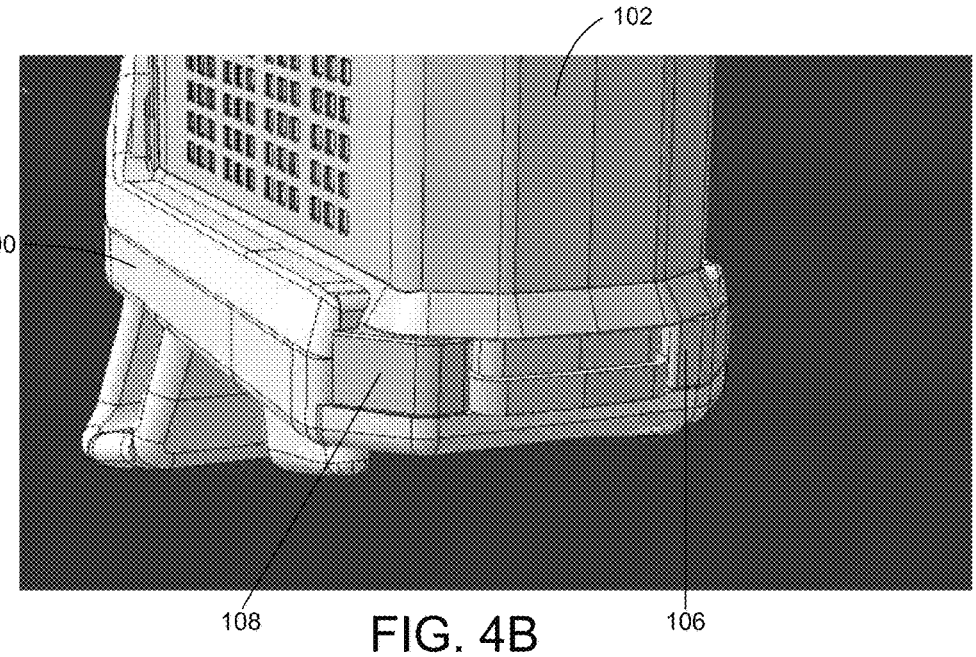
Figure 6A:
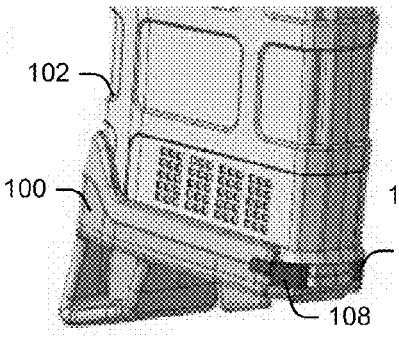
FIGS. 6A and 6B depict a sequence for attaching the shooting rest according to an embodiment.
Figure 6B:
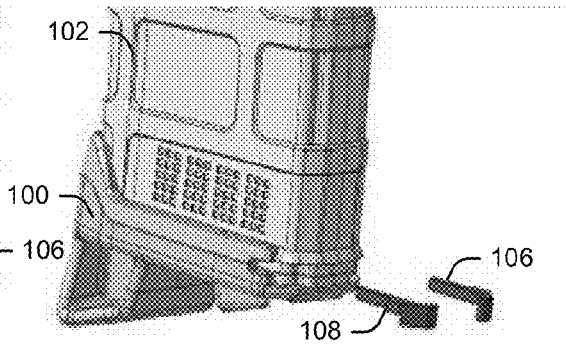

FIGS. 4A and 4B depict another embodiment of the first retaining clip 106 and the second retaining clip 108. A channel 110 may be formed about the lateral interior wall of shooting rest 100. The channel 110 may extend about the entire interior of the shooting rest 100 or on the lateral sides thereof. The channel 110 may be configured to engage a lip 112 on the firearm magazine 102. In this manner, the channel 110 may be slid on to and off of the lip 112 in order to attach the shooting rest 100 to the firearm magazine 102.

The first retaining clip 106 and the second retaining clip 108 may include an elongated portion 114, with a substantially transverse tab 116 extending from one end thereof. In some instances, the tab 116 may extend in two directions from the end of the elongated portion 114. In this manner, the first retaining clip 106 and the second retaining clip 108 may resemble the outline of a hammer. At least a portion of the tab 116 may nest within a notch 118 in the back portion of the firearm magazine 102. The elongated portion 114 may be partially or fully disposed within a side slot 120. The side slot 120 may be formed between the channel 110, the lip 112, a bottom interior surface of the shooting rest 100, and a sidewall of the firearm magazine 102. The tab 116 may wrap around the back portion of the bottom portion of the firearm magazine 102 and nest within the notch 118. A laterally extending lip 122 on the tap 116 may abut a side wall of the shooting rest 100. FIG. 4B depicts the first retaining clip 106 and the second retaining clip 108 inserted into the respective slots 120 with the taps 116 positioned with the respective notches 118.

Figure 7A:
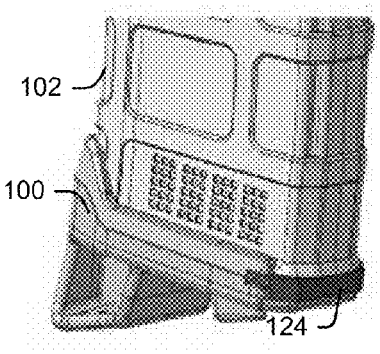
FIGS. 7A and 7B depict a sequence for attaching the shooting rest according to an embodiment.
Figure 7B:
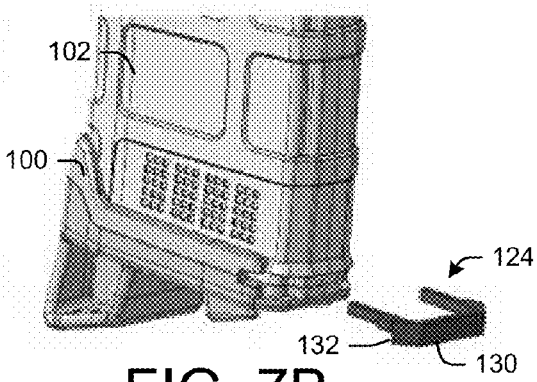

As depicted in FIGS. 5A-5C, the one or more removable retaining clips 104 may comprise a single substantially U-shaped retaining clip 124. The substantially U-shaped retaining clip 124 may be at least partially disposed within the side slots 120 formed between the magazine floor coupling and the bottom portion of the firearm magazine 102. The substantially U-shaped retaining clip 124 may include a first side elongated portion 126, a second side elongated portion 128, and a substantially transverse portion 130 connecting the first side elongated portion 126 and the second side elongated portion 128. At least a portion of the transverse portion 130 may nest within the notches 118 in the back portion of the firearm magazine 102. The first side elongated portion 126 and the second side elongated portion 128 may be partially or fully disposed within the side slots 120, and the transverse portion 130 may wrap around the back portion of the bottom portion of the firearm magazine 102 and nest within the notches 118. In some instances, as depicted in FIGS. 7A and 7B, a laterally extending lip 132 on the tab transverse portion 130 may abut a side wall of the shooting rest 100. As can be seen in FIGS. 6A-7B, the substantially U-shaped retaining clip 124 may be similar in size, shape, and configuration to the two separate retaining clips 106, 108, except that the substantially U-shaped retaining clip 124 is connected together with the transverse portion 130.

Figure 8C:
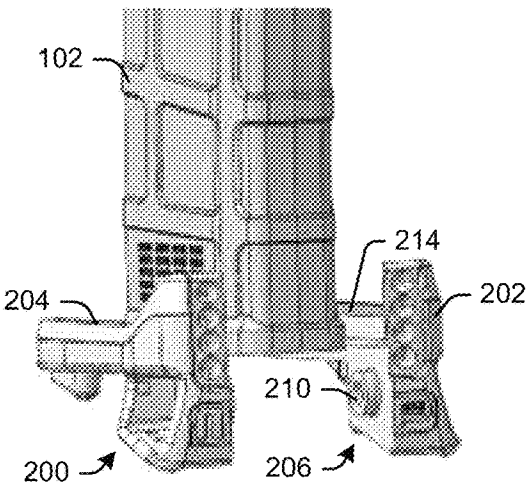
FIGS. 8A-8C depict an exploded view of the shooting rest according to an embodiment.
Figure 8B:
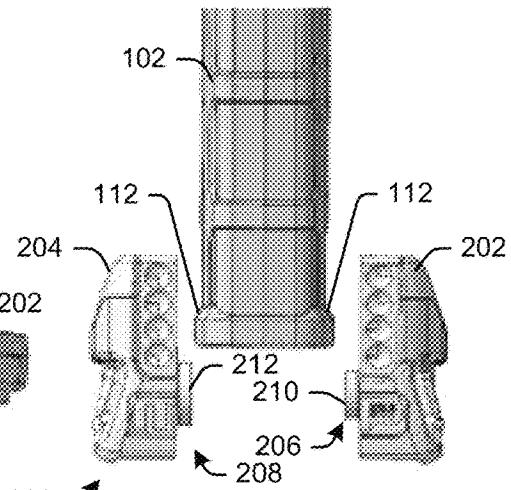
Figure 8A:
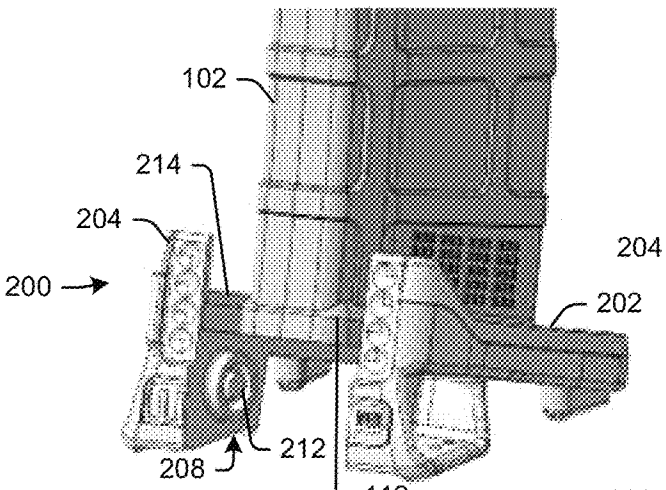

FIGS. 8A-8C depicts a shooting rest 200. The shooting rest 200 may comprise multiple components that are snap-fit together. For example, the shooting rest 200 may comprise a first half 202 and a second half 204. The first half 202 and the second half 204 may be attached to the firearm magazine 102 by pressing the first half 202 together with the second half 204. In some instances, the first half 202 may snap-fit to the second half 204 about the firearm magazine 102. In some instances, the first half 202 may include a first attachment point 206 and the second half 204 may include a second attachment points 208. Any number of attachment points may be used. The first attachment point 206 may be configured to mate with the second attachment point 208 in order to secure the first half 202 to the second half 204. For example, the first attachment point 206 may include a circular lip 210 and the second attachment 208 point may include a circular channel 212 that the circular lip 210 is press-fit into. In this manner, the first half 202 and the second half 204 may be disposed on opposite sides of the firearm magazine 102 and press-fit and/or snap-fit together about the firearm magazine 102. The first half 202 and the second half 204 may each include a channel 214 that surrounds the lip 112 of the firearm magazine 102 to secure the shooting rest 200 to the firearm magazine 102 once the first half 202 and the second half 204 are pressed together. In some instances, the retaining clips discussed above may also be used with the shooting rest 200 to further secure it to the firearm magazine 102.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed:

1. A shooting rest, comprising: a set of lateral halves of a magazine floor coupling relative to a firearm magazine, comprising a first half of the magazine floor coupling, configured to couple to a bottom portion of the firearm magazine; and a second half of the magazine floor coupling configured to couple to the bottom portion of the firearm magazine wherein the first half of the magazine floor coupling comprises a circular lip wherein the circular lip is surrounded on an interior and exterior of the circular lip by a channel of the second half of the magazine floor coupling.

2. The shooting rest of claim 1, wherein the first half and the second half are attached to the bottom portion of the firearm magazine by pressing the first half together with the second half.

3. The shooting rest of claim 1, wherein the first half comprises a first attachment point and the second half comprises a second attachment points.

4. The shooting rest of claim 3, wherein the first attachment point comprises a circular lip and the second attachment point comprises a circular channel that the circular lip is configured to mate with.

5. The shooting rest of claim 1, wherein the first half and the second half of the magazine floor coupling each include a channel that surrounds a lip on the bottom portion of the firearm magazine.

6. The shooting rest of claim 1, further comprising:

a set of front legs, wherein at least one leg of the set of front legs attach to the first half of the magazine floor coupling and at least one leg of the set of front legs attach to the second half of the magazine floor coupling; and a set of rear legs, wherein at least one leg of the set of rear legs attach to the first half of the magazine floor coupling and at least one leg of the set of rear legs attach to the second half of the magazine floor coupling.

7. The shooting rest of claim 6, wherein the set of front legs comprise a U-shaped wall.

8. The shooting rest of claim 6, wherein the first half and the second half of the magazine floor coupling each comprise a front end and a back end, wherein the front legs attach at the front end and the rear legs attach at the back end.

9. A shooting rest, comprising: a first half of a magazine floor coupling configured to couple to a bottom portion of a firearm magazine, wherein the first half comprises a circular lip; and a second half of the magazine floor coupling configured to couple to the bottom portion of the firearm magazine, wherein the second half comprises a circular channel configured to mate with the circular tip wherein the circular lip is surrounded on an interior and exterior of the circular lip by said circular channel of the second half of the magazine floor coupling.

10. A shooting rest, comprising: a first half of a magazine floor coupling configured to couple to a bottom portion of a firearm magazine, wherein the first half comprises a lip; and a second half of the magazine floor coupling configured to couple to the bottom portion of the firearm magazine, wherein the second half comprises a channel configured to mate with the lip wherein the circular lip is surrounded on an interior and exterior of the circular lip by said channel of the second half of the magazine floor coupling.

11. The shooting rest of claim 10, wherein the first half and the second half of the magazine floor coupling couple to a rim of the firearm magazine.

12. The shooting rest of claim 10, wherein the first half and the second half of the magazine floor coupling comprise a plurality of legs.

* * * * *